US007083500B2

(12) United States Patent
Junker

(10) Patent No.: US 7,083,500 B2
(45) Date of Patent: Aug. 1, 2006

(54) METHOD AND DEVICE FOR GRINDING THE OUTSIDE AND INSIDE OF A ROTATIONALLY SYMMETRIC MACHINE PART COMPRISING A LONGITUDINAL BOREHOLE

(75) Inventor: Erwin Junker, Buehl/Baden (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 0 days.

(21) Appl. No.: 10/523,883

(22) PCT Filed: Jul. 30, 2003

(86) PCT No.: PCT/EP03/08437

§ 371 (c)(1),
(2), (4) Date: Feb. 7, 2005

(87) PCT Pub. No.: WO2004/014606

PCT Pub. Date: Feb. 19, 2004

(65) Prior Publication Data

US 2005/0260926 A1 Nov. 24, 2005

(30) Foreign Application Priority Data

Aug. 5, 2002 (DE) ..... 102 35 808

(51) Int. Cl.
*B24B 49/00* (2006.01)
*B24B 1/00* (2006.01)

(52) U.S. Cl. ..... 451/10; 11/51; 11/57; 11/61; 11/180

(58) Field of Classification Search ..... 451/10, 451/11, 49, 51, 57, 61, 180, 246, 283, 285, 451/398

See application file for complete search history.

(56) References Cited

U.S. PATENT DOCUMENTS 3,646,708 A * 3/1972 Jones ..... 451/72

(Continued)

FOREIGN PATENT DOCUMENTS

| | | |
|---|---|---|
| DE | 41 23 045 | 1/1993 |
| EP | 0 361 446 | 4/1990 |
| EP | 0 457 016 | 11/1991 |
| EP | 1 022 091 | 7/2000 |
| GB | 191222457 | 0/1913 |

OTHER PUBLICATIONS

May 9, 1999 "Komplett in Einer Aufspannung Schleifen" Werkstatt und Betrieb, Carl Hanser Verlag, Muenchen, Germany Zdenek Brychta vol. 132 pp. 101-103.

*Primary Examiner*—Eileen P. Morgan
(74) *Attorney, Agent, or Firm*—Jordan and Hamburg LLP

(57) ABSTRACT

A machine part with a conical effective surface, which is machined by means of a device comprising a machine bed, a longitudinally movable grinding bench, and a workpiece spindle head that clamps the machine part by means of clamping jaws via a chuck. The conical effective surface of the machine part is ground by means of a first grinding disk in a vertical grinding mode by longitudinally moving the grinding bench in the direction of the longitudinal axis. The associated grinding spindle head is provided with a first grinding spindle for the first grinding disk and a second grinding spindle for a second grinding disk that is fixed to a grinding arbor. The grinding spindle head is fixed to a grinding spindle carriage so as to be pivotable around a vertical shaft, the grinding spindle carriage being movable in the direction of the x-axis via a displacement motor. The first grinding disk can be driven out of the area of the machine part while the second grinding disk can be made to act upon the machine part in order to internally grind a longitudinal borehole.

16 Claims, 5 Drawing Sheets

U.S. PATENT DOCUMENTS 4,005,552 A * 2/1977 Hoglund et al. ..... 451/239
4,051,830 A * 10/1977 Gruber ..... 125/11.01
4,374,513 A * 2/1983 Wiener ..... 125/11.03
5,044,125 A * 9/1991 Lambert et al. ..... 451/27
5,076,022 A 12/1991 Ohta et al.
5,139,005 A * 8/1992 Dodd ..... 125/11.01

* cited by examiner

METHOD AND DEVICE FOR GRINDING THE OUTSIDE AND INSIDE OF A ROTATIONALLY SYMMETRIC MACHINE PART COMPRISING A LONGITUDINAL BOREHOLE

BACKGROUND OF THE INVENTION

The invention relates to a method for grinding a rotationally symmetrical machine part provided with a longitudinal bore, a one end-face surface of which is embodied as an active surface in the form in particular of a flat truncated cone with a cross-section with a straight or curved contour.

The machine parts to be ground with this method are present for instance in transmissions with continuously variable gears, as are needed in motor vehicles. Two machine parts oppose one another with active surfaces facing one another. The active surfaces thus form an annular space with a nearly wedge-shaped cross-section in which a tension member, such as for instance a chain or a belt, moves in and out between different radii depending on a distance from the active surfaces. Since such a transmission must work very precisely and transmit large torques, high demands are placed on the dimensional stability and surface quality of the machine parts. This also applies to the associated grinding procedures, in particular when grinding the active surface.

In accordance with the prior art known from commercial practice, the method cited in the foregoing has been performed in single operations, that is, in a plurality of clampings. The active surface is ground by means of corundum grinding wheels using the angular infeed grinding method. For interior cylindrical grinding of a longitudinal bore located on the machine part, the machine part must then be clamped in another machine, where the internal cylindrical grinding of the bore wall can occur using an appropriate small grinding wheel.

The known method has a number of disadvantages. First, it requires grinding wheels with a conical shape or with a highly graduated diameter, which are difficult to manufacture and dress. In such grinding wheels with circumferential regions of very different diameters, the circumferential speeds of the regions to be ground are also different. This means that the critical cutting speed at the grinding location must be different and therefore cannot be optimal over all. The result of this are regions of varying roughness, which has a negative effect on the active surface. Finally, there are also problems involving cooling by means of the conventional emulsions and grinding oils. That is, during angular infeed grinding a narrowing wedge occurs at the grinding location, and coolant/lubricant cannot be fed to it optimally. The result is thus uneven cooling of the grinding location. All of these difficulties can be traced back to the fact that the aforesaid known method has in the past been performed with corundum grinding wheels, which have a significantly shorter service life and must be dressed more frequently than CBN grinding wheels, which have since come into wide use.

DD 143 700 concerns an apparatus for grinding tungsten plates that are used for instance as rotating electrodes in x-ray tubes. According to the drawing, such a tungsten plate has the contour of a truncated cone in which the incline of the surface line is approximately 30° relative to the base. In this known apparatus, the tungsten plate is clamped in a workpiece holder that is pivotable about an axis perpendicular to the apparatus frame. Situated opposing the workpiece holder is a longitudinal support that is displaceable in the horizontal plane. Arranged on the longitudinal support is a compound slide rest that carries a grinding spindle for driving a small cylindrical grinding wheel that acts for internal grinding of a bore in the tungsten plate. Separated from this compound slide rest, the longitudinal support furthermore carries a rigid electrogrinding spindle for driving a conical grinding wheel. One end face and the cone envelope-shape region of the tungsten plate is to be ground with the conical grinding wheel. For this, the conical grinding wheel and the tungsten plate must be brought into the correct position relative to one another by pivoting the workpiece holder, displacing the longitudinal support, and using manually actuated advancing controls.

Nothing other than angled grinding in the region of the cone envelope can be done by DD 143 700. The known apparatus, which must in part be operated manually, is difficult to operate and requires some skill.

Known from EP 1 022 091 A2 is a tool machine for grinding workpieces in which two cylindrical grinding wheels of different sizes are situated on one turret that is itself arranged on a displaceable slide. By pivoting the turret 180°, the two grinding wheels can be selectively brought up against different regions of a rotationally symmetrical workpiece. The workpiece is arranged in a workpiece receiver that is itself displaceable in the longitudinal direction of the workpiece. For grinding, the workpiece is rotated. In addition, in this known workpiece machine the workpiece receiver can be adjusted about an angle of +/−30° inclined to the displacement direction of the workpiece receiver. EP 1 022 091 A2 does not explain how grinding should proceed when the workpiece receiver is in an angled position. However, since pivoting of the turret carrying the grinding wheel is expressly indicated in increments of 90°, it is obvious that with this known tool machine, as well, longitudinal grinding with one grinding wheel is intended when conical exterior contours with significant angles of inclination in the cone are to be ground.

SUMMARY OF THE INVENTION

In contrast to this, the object of the invention is to provide a method and apparatus of the type cited initially in the foregoing with which the processing time can be decreased and a better grinding result can still be obtained.

This object is attained by having the active surface on the machine part held on one side at its exterior circumference and ground, a rotating circumferential contour of the a cylindrical grinding wheel being positioned perpendicularly against the active surface, the machine-part being displaced in the direction of its rotational and longitudinal axis relative to the first grinding wheel, whereby the axial extension of the first grinding wheel covers the radial angled extension of the active surface, and in that then, in the same clamping, the interior wall of the longitudinal bore is ground. A second grinding wheel of smaller diameter is introduced into the longitudinal bore of the machine part by pivoting a grinding headstock, which carries at least the first and the second grinding wheel, and positioned radially against the interior wall.

Thus in the method the machine part to be ground remains in a single clamping slate in which all of the grinding procedures are undertaken. This is made possible in that first, a first cylindrical grinding wheel is placed perpendicularly against the active surface and then a second cylindrical grinding wheel of smaller diameter is inserted into a longitudinal bore of the machine part and placed radially against an interior wall. The options for using two different grinding wheels on different processing surfaces of one and the same workpiece are known in general to one skilled in the art.

One special feature with the present invention is that the first grinding wheel is placed perpendicularly at a rotating circumferential surface thereof against the active surface that runs on an incline, whereby axial extension or width of the first grinding wheel covers the radial angular extension of the active surface. Thus, the active surface is ground with a cylindrical circumferential surface of the grinding wheel using the vertical grinding method, whereby positioning is effected by mutual relative displacement.

A uniform cutting speed across the entire width of the grinding wheel results as an advantage. This ensures improved-surface quality and surface structure. In addition, optimized dressing parameters are obtained when dressing the grinding wheel because when dressing the same parameters, namely, identical dressing speed, is attained as when grinding, as are the same revolutions per minute and advance values. Because the cutting speed of the grinding wheel remains the same across the active surface, the attainable surface roughness also remains the same. Optimum values for cutting volume per unit of time can also be attained using the same cutting speed of the grinding wheel across the entire conical surface.

This is not the case for angular infeed grinding. Given an exterior diameter of the conical active surface, if one assumes a value of for instance 190 mm and an adjacent mean diameter (in the region of the longitudinal bore) on the active surface of 40 mm, the workpiece speed changes by a factor of 4.75 because of the rotation of the workpiece during grinding. The height of the conical surface is thus approx. 75 mm.

Given an assumed diameter of the corundum grinding wheel of 750 mm, the cutting speed at the exterior diameter of the conical surface is then approx. 80% of the cutting speed of the grinding wheel at the smallest diameter of the conical surface. This opposes the cutting volume, because it is highest at the greatest diameter on the conical surface. This means that because of the grinding wheel being placed perpendicular to the conical surface, the ratio of cutting speed to cutting volume that has to be carried across the conical surface is substantially improved.

Furthermore, significantly improved conditions when cooling the grinding zone result because practically these same conditions occur when grinding the active surface as during vertical grinding, so that there is a uniformly narrow cooling zone to which it is easy to feed the coolant/lubricant and which it also exits rapidly as well.

Overall, such advantages result that the grinding method can be best performed with ceramic bound CBN grinding wheels. Overall there is clearly a reduced number of cycles on modern processing machines with simultaneously substantially improved grinding results.

Fundamentally it would be possible for the first grinding wheel to be placed against the active surface of the machine part to be ground in the strictly radial direction in that the first grinding wheel is moved transverse to its longitudinal extension and in the angled direction to the machine part. In this case the machine part would have to be arranged at a position of the associated machine bed that remains the same. However, the apparatus required for performing the method is simpler when in accordance with the inventive method positioning occurs in that the machine part is displaced in the direction of its rotational and longitudinal axis relative to the first grinding wheel. From this movement, only an angled component falls on the grinding site on the active surface, but component deviates by only a small amount from the direction of the longitudinal axis so that there is nearly still vertical grinding in the conventional sense. A lower force component results in the radial direction of the active surface so that the running surface can be worked with optimized advancing during grinding. This also reduces the grinding time, and improved accuracies in the grinding condition of the active surface still result.

The subsequent interior grinding of the longitudinal bore can be undertaken using longitudinal grinding. The procedure for peel-grinding, in which grinding is performed directly to the final diameter, also comes into consideration. However, it is also possible for the interior wall of the longitudinal bore to be ground using infeed grinding.

The latter method is particularly considered when in accordance with another advantageous method variant individual axial segments of the interior wall of the longitudinal bore are ground.

In a further design of the method of the present invention, at least three grinding wheels are provided that are brought into their working position by pivoting three grinding spindles that carry the grinding wheels. Additional grinding procedures can be performed using the method expanded in this manner, or for instance interior cylindrical grinding can also occur in the conventional steps of pregrinding and finish grinding.

Finally, it is not mandatory to follow the sequence in which first the active surface of the machine part and then the interior wall of the longitudinal bore is ground. Fundamentally the reverse sequence is also possible. One skilled in the art of grinding will establish the sequence of procedures depending on the design of the machine part, because the amount of heating during grinding and the type of clamping are important.

The invention also relates to an apparatus for grinding a rotationally symmetrical machine part of the type cited in the foregoing in connection with the method. In an apparatus for grinding a rotationally symmetrical machine part provided with a longitudinal bore, one end-face surface of which is embodied as an active surface in the form of a flat truncated cone with a cross-section with a straight contour, in particular for performing the method in accordance with the above recited method there is provided:

- a clamping device for one-sided clamping of the machine part at its exterior circumference and for rotationally driving it,
- a grinding spindle slide that can be moved in a direction running transverse to the rotational and longitudinal axis of the machine part,
- a device for longitudinal displacement of the machine part in the direction of its rotational and longitudinal axis,
- a grinding headstock that is attached to the grinding spindle slide via a pivot axis running perpendicular to the displacement plane of the grinding spindle slide and that carries at least two grinding spindles that can be pivoted into the working position,
- a first cylindrical grinding wheel, arranged on the first grinding spindle and driven thereby, that is for vertical grinding of the active surface situated on the machine part and that has an axial extension that is larger than the radial angled extension of the active surface,
- and a second cylindrical grinding wheel, arranged on the second grinding spindle and driven thereby, that has a smaller diameter than the first grinding wheel and that is for interior cylindrical grinding of the longitudinal bore of the machine part,
- whereby, depending on the pivot position of the grinding headstock, either the rotating circumferential surface of the first grinding wheel is placed on the active surface of the machine part to be ground or the axis of the second grinding wheel runs spaced from and parallel to the rotational and longitudinal axis of the machine part.

When the apparatus is operated according to the method described in the foregoing, first the grinding spindle slide is moved in the correct manner to the clamped machine part and the grinding headstock is rotated such that the first grinding spindle, at the cylindrical circumferential surface of the first grinding wheel affixed on it, is placed against the active surface of the machine part. The first grinding spindle must assume an angled position relative to the rotational and longitudinal axis of the machine part that is less than 90°. Then the active surface can be ground by the first grinding wheel using the vertical grinding method, that is, with its known advantages. Subsequently the grinding spindle slide is moved somewhat outward transverse to the rotational and longitudinal axis of the machine part and the grinding headstock situated on the grinding spindle slide is rotated about its pivot axis until the rotational axis of the second grinding spindle with the associated second grinding wheel is approximately in the rotational and longitudinal axis of the machine part. The second grinding wheel is then inserted into the longitudinal bore of the machine part and positioned radially so that interior cylindrical grinding of the longitudinal bore is performed. In this manner all necessary grinding procedures on the machine part are accomplished in one single clamping. However, the prerequisite in every case is a first grinding wheel, the axial extension or width of which is greater than the angled extension of the active surface, because otherwise the vertical grinding method of the active surface, with all its advantages, cannot occur.

One constructive advantageous further development of the inventive apparatus is that in the arrangement of two grinding spindles on the grinding headstock their axes run parallel to one another and the two grinding wheels are attached on the same side of the grinding headstock. In this manner it is possible to change between the two processing procedures with only minor displacement and pivot paths of the grinding headstock.

If additional grinding procedures are to be performed or if one of the individual procedures is to be performed in a plurality of steps, it can be advantageous when, in accordance with another embodiment three grinding spindles, each with a grinding wheel, are attached to the grinding headstock at angle intervals of 120° each. Then one of the three grinding spindles is selectively brought into the working position.

Advantageously, the clamping device is a chuck with centrally adjustable clamping jaws and that can also be driven to rotate. Such chucks have proved to be reliable and are known.

In accordance with one additional embodiment, it is advantageous when the clamping device is located on a grinding table that can be moved in the rotational and longitudinal axis of the machine part relative to the grinding spindle slide. The positioning movement when grinding the active surface is then performed in that the grinding table, with the machine part, is moved in the longitudinal direction of the machine part relative to the first grinding wheel.

BRIEF DESCRIPTION OF THE DRAWINGS

The invention will be described in greater detail in an exemplary embodiment using the figures.

DESCRIPTION OF THE PREFERRED EMBODIMENTS

Figure 1:
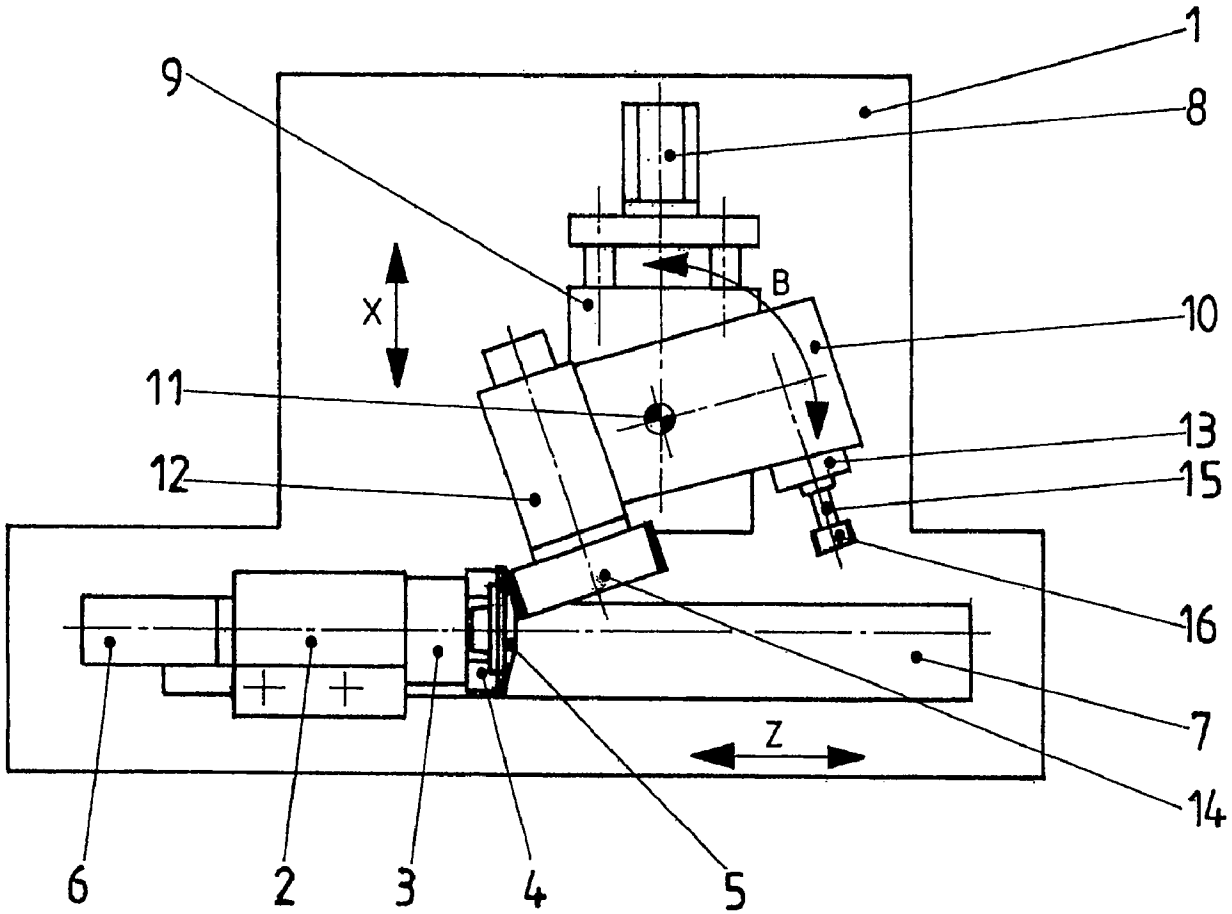
FIG. 1 is a view from above onto an inventive apparatus in a first processing phase.

FIG. 1 first provides a schematic illustration of an apparatus with which a method for grinding can be performed. A top view of an apparatus for grinding the machine part is shown. Situated on a machine bed 1 is a workpiece headstock 2. It is provided with a chuck 3 that is driven to rotate and on which are situated four clamping jaws 4 that are centrally controlled. The machine part to be ground, labeled 5, will be described greater detail below.

The workpiece headstock 2 has a longitudinal axis 6 that is also the rotational axis of the chuck 3. When the machine part 5 is clamped in the chuck 3, the rotational and longitudinal axes of the workpiece headstock and the machine part 5 coincide.

In the exemplary embodiment illustrated, the workpiece headstock 2 is affixed to a grinding table 7. Together with the workpiece headstock 2, the grinding table 7 is moved in the direction of the longitudinal axis 6, which is also the conventional Z-axis in the context of a CNC control.

Furthermore situated on the machine bed 1 is a grinding spindle slide 9 that can be moved by means of a displacement motor 8 in a direction transverse to the longitudinal axis 6 of the workpiece headstock 2. On the grinding spindle slide 9, a grinding headstock 10 is pivotably arranged about a pivot axis 11. The direction of pivot is indicated by the rotating arrow B. The pivot axis 11 is perpendicular to the grinding spindle slide 9 and will normally run vertically.

A first grinding spindle 12 and a second grinding spindle 13 are situated on the grinding headstock 10. The rotational and drive axes of the two grinding spindles are parallel. A first grinding wheel 14 is affixed to the grinding spindle 12. The grinding spindle 13 is fitted with a second grinding wheel 16 that is affixed to a grinding arbor 15. As FIG. 1 clearly indicates, the first grinding wheel 14 and the second grinding wheel 16 are both arranged on the same side of the grinding headstock 10.

FIG. 1 illustrates the first processing phase of the grinding procedure in which the circumferential surface of the first grinding wheel 14 is placed against the active surface of the machine part 5 to be ground.

Figure 2:
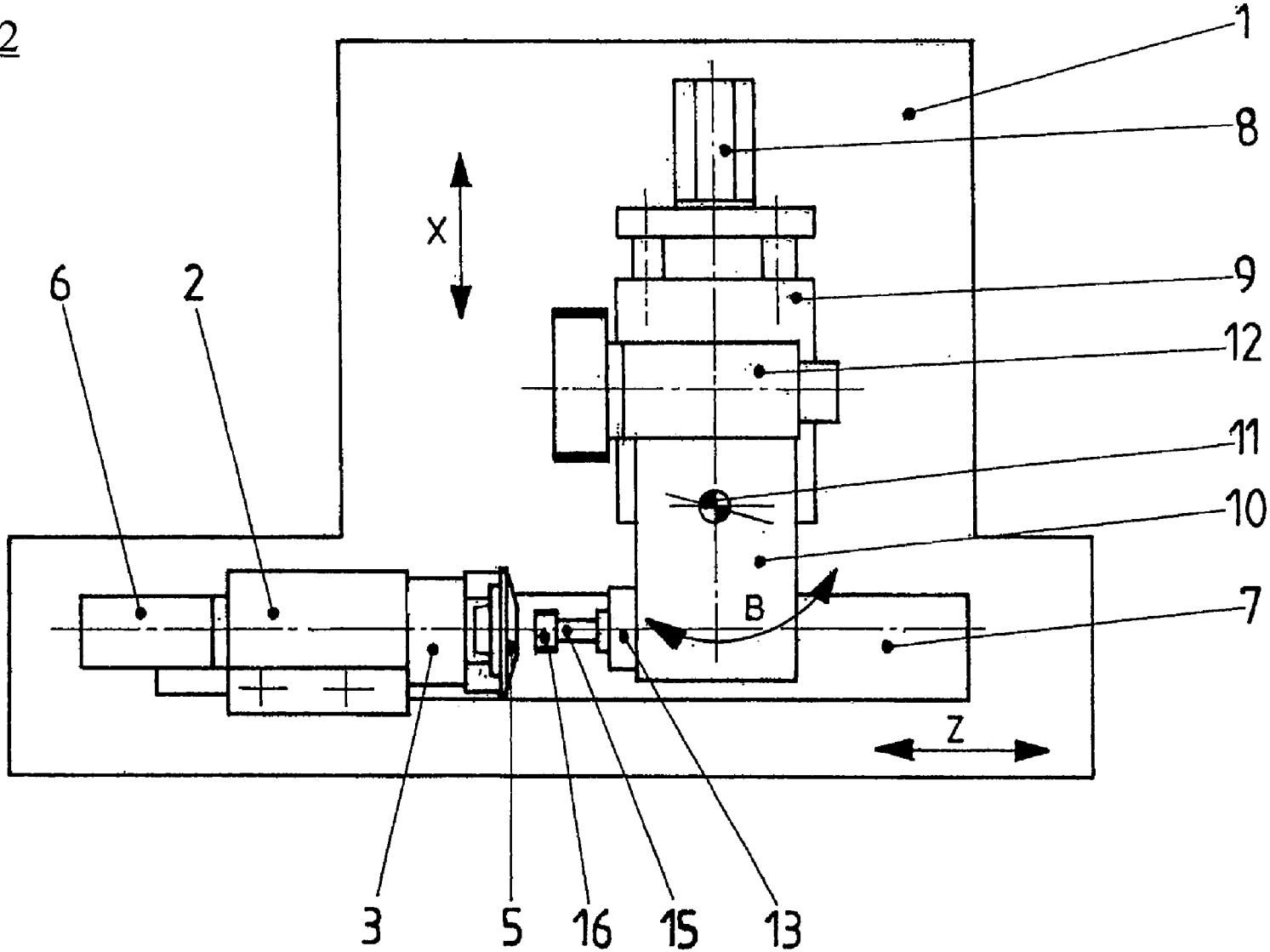
FIG. 2 depicts a view corresponding to that in FIG. 1 in the subsequent processing phase.

FIG. 2 provides a view of the second processing phase in which the axis of the second grinding wheel 16 runs spaced from and parallel to the longitudinal axis 6 of the workpiece headstock 2.

In order to move from the position in accordance with FIG. 1 to the position in accordance with FIG. 2, first the grinding spindle slide 9 must be moved somewhat outward in the direction of the X-axis, that is, transverse to the direction of the longitudinal axis 6. Then the grinding headstock 10 on the grinding spindle slide 9 can be pivoted about an angle of somewhat more than 90°, whereupon the second grinding spindle 13 with the second grinding wheel 16 assumes the position visible in FIG. 2. The pivoting movement is also illustrated by the rotating arrow B in FIG. 2.

Figure 3:
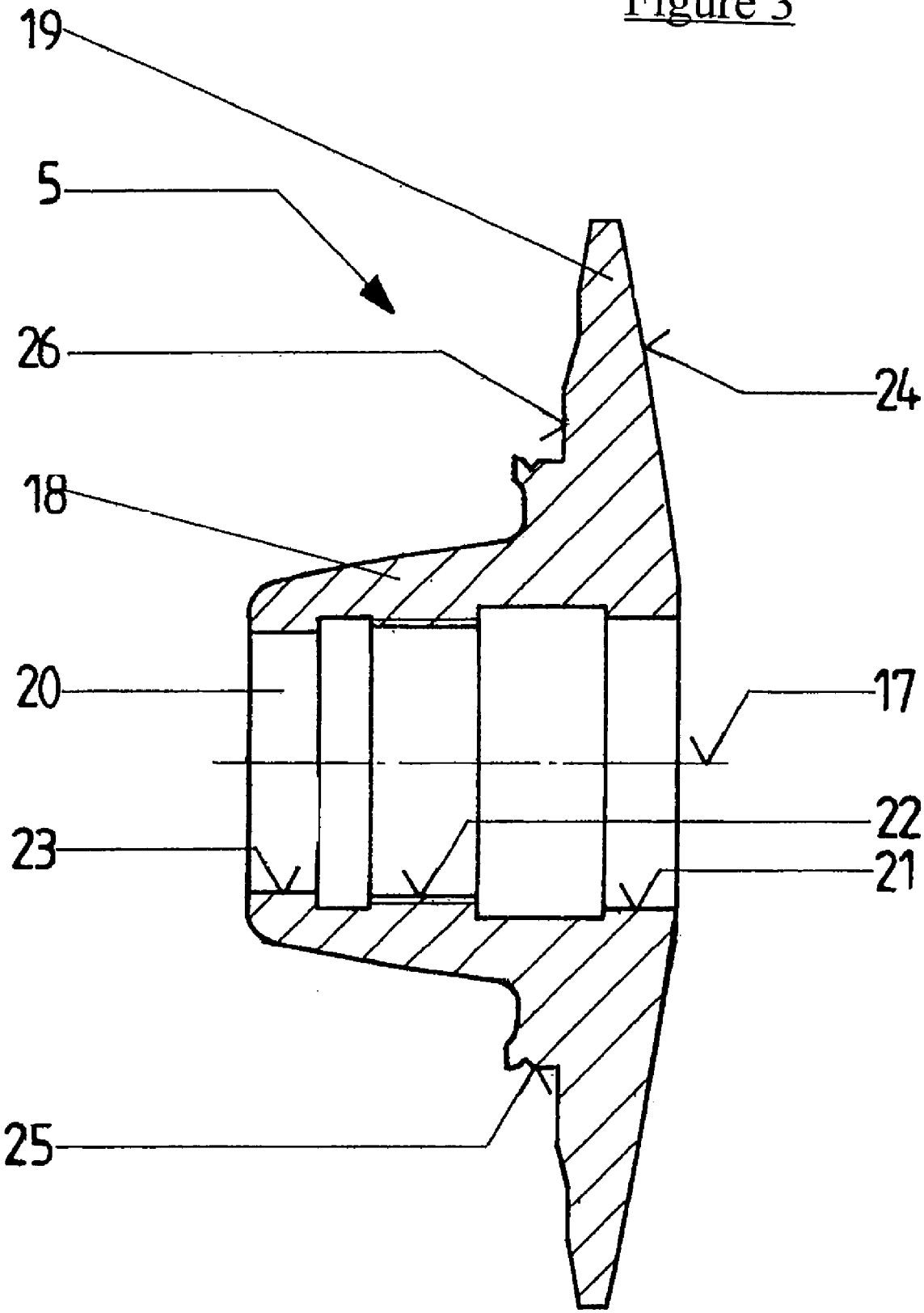
FIG. 3 is a section of the machine part to be ground.

FIG. 3 is an enlarged section of the machine part 5 to be ground. The machine part is rotationally symmetrical to the rotational and longitudinal axis 17. It comprises a hub part 18 and a coned flange 19 and a longitudinal bore 20 passes through its entire length.

The longitudinal bore can be graduated so that it is not necessary to grind its entire length. In general it is sufficient when the longitudinal bore is ground on the axial segments 21, 22, and 23. At its large end-face surface, the coned flange 19 is embodied like a flat truncated cone with a cross-section that has a straight contour.

The machine part illustrated is a conical disk in a continuously variable gear; in its assembled condition, a chain, belt, or the like slides on the active surface 24. Two active surfaces 24 oppose one another; by changing the distance between them, the radius on which the chain or belt slides can be changed, this resulting in different transmission ratios. Thus it is clear how important the entire and careful grinding of the active surface 24 is for the functioning of the finished continuously variable gear.

The machine part illustrated in FIG. 3 has a cylindrical clamping surface 25 and a planar stop surface 26 that are for clamping in the aforesaid chuck 3. The clamping jaws 4 enclose the cylindrical clamping surface 25, while the axial stop is provided by the stop surface 26 on the clamping jaws 4. The machine part 5 is thus clamped exteriorly on one side so that the entire end face, which is on the right-hand side in FIG. 3, and in particular the active surface 24 are free for processing. In addition, a small grinding wheel can be inserted into the longitudinal bore 20 for the purpose of interior grinding.

Figure 4:
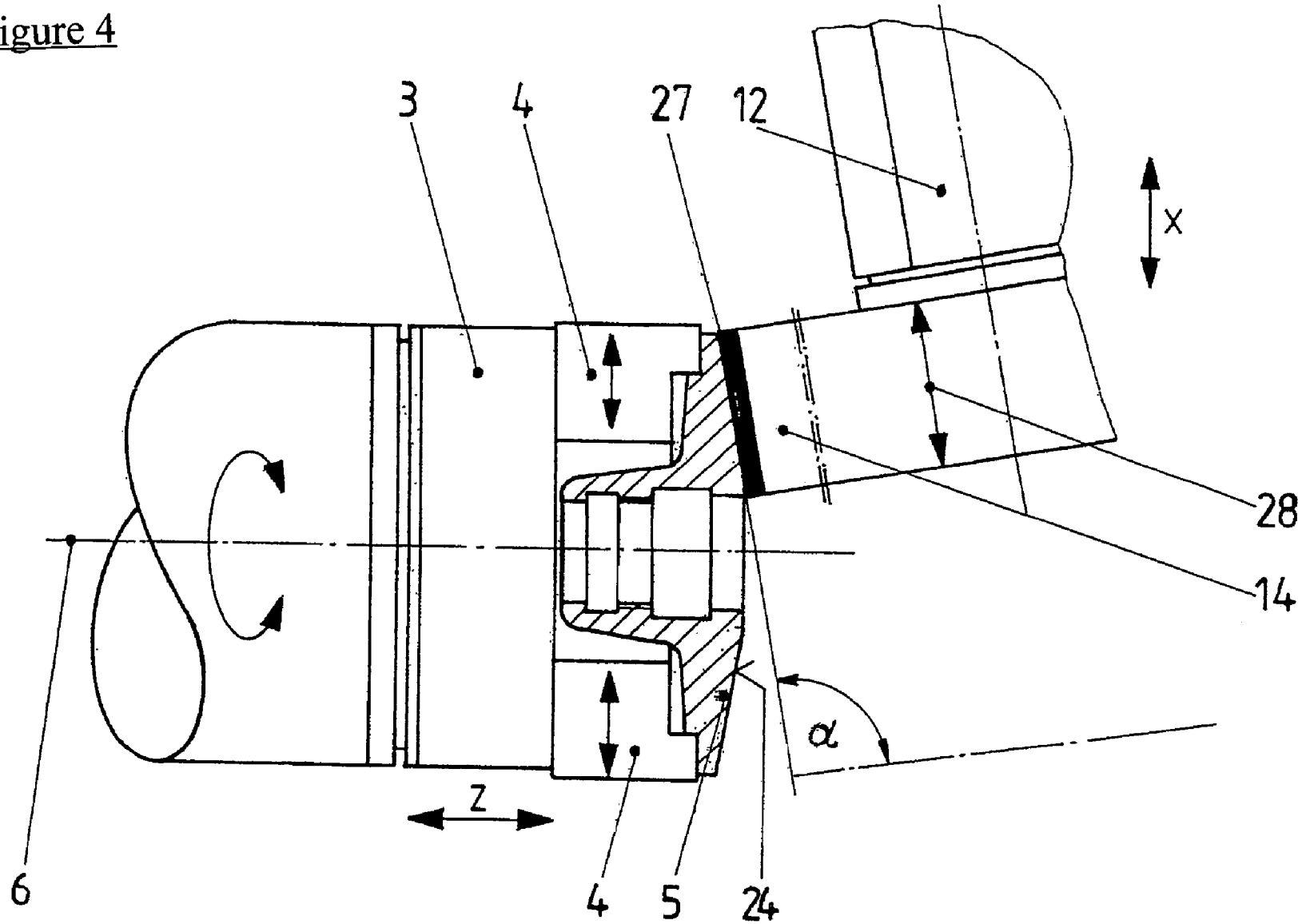
FIG. 4 explains how the inventive method is performed in the first processing phase.

FIG. 4 illustrates the first processing phase in which the active surface 24 of the machine part 5 is ground using vertical grinding.

As stated in the foregoing, first the machine part 5 is clamped between the clamping jaws 4 of the chuck 3. The workpiece spindle is then driven to rotate, as a rule by a variable-speed electromotor. With this, the machine part 5 rotates about its rotational and longitudinal axis 17, which is identical to the longitudinal axis 6 of the workpiece headstock 2.

The first grinding spindle 12 with the first grinding wheel 14 is already in the position described using FIG. 1. In that the machine table 7 with the workpiece headstock 2 is now displaced to the right in the direction of the Z-axis in FIG. 4, the rotating first grinding wheel is positioned against the active surface 24 of the machine part 5. The axial extension 28 of the second grinding wheel 14 is somewhat larger than the radial angled extension of the machine part 5. Thus the entire active surface 24 is ground by the first grinding wheel 14 using the vertical grinding method with the advantages described in the foregoing.

The first grinding wheel 14 is a ceramic bound CBN wheel that provides a long tool life.

Figure 5:
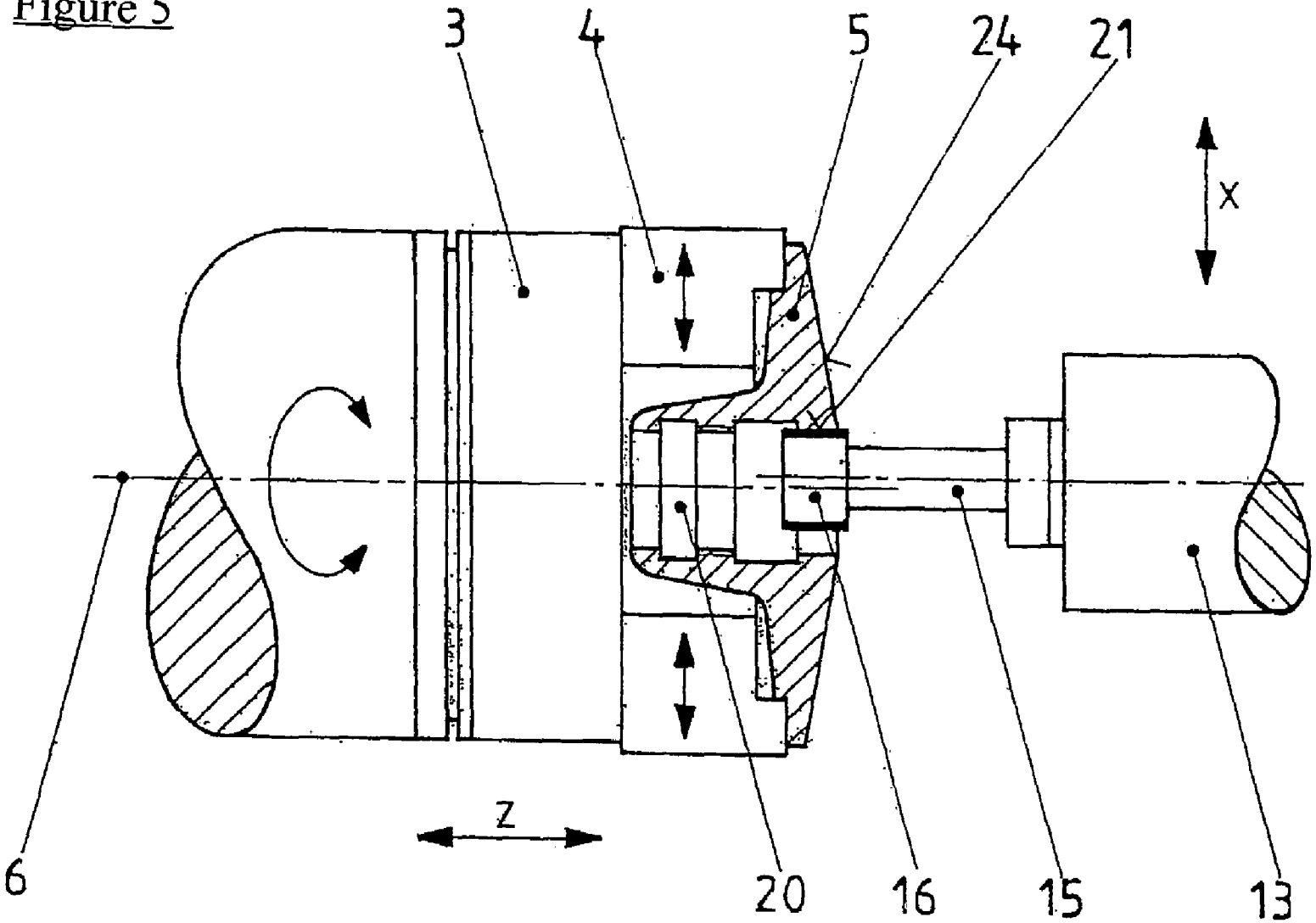
FIG. 5 is the depiction corresponding to that in FIG. 4 of the second processing phase.

FIG. 5 depicts the second processing phase, which corresponds to the view in accordance with FIG. 2. In the illustration in accordance with FIG. 5, the second grinding wheel 16 has already been inserted into the longitudinal bore 20 and is processing the axial segment 21 of the longitudinal bore 20. The rotational axis of the second grinding wheel 16 is situated spaced from and parallel to the common longitudinal axis 6 of the workpiece headstock 2 and machine part 5. In this phase interior grinding of the segments 21, 22, and 23 of the longitudinal bore 20 is performed, whereby this cylindrical grinding can occur as longitudinal grinding, rough-grinding, or angular infeed grinding.

The invention claimed is:

1. A method for grinding a workpiece which is rotationally symmetrical about a workpiece axis and has a longitudinal bore and first and second end sides axially opposing each other, said first end side having a substantially conical surface to be ground which is truncated and has a meridian cross-section having a substantially straight contour along the said substantially conical surface, comprising:

chucking said workpiece at said second end side to place the workpiece into a chucked state without chucking said workpiece at said first end side;

rotating said workpiece in said chucked state about a workpiece;

providing a first grinding wheel on a pivoting grinding headstock, said first grinding wheel having first and second annular side surfaces, and an outer grinding wheel surface between said first and second annular side surfaces;

said outer grinding wheel surface being defined by a substantially straight line contour extending in an axial direction and parallel to an axis of said first grinding wheel, an axial length of said outer grinding wheel surface of said first grinding wheel extending over an entirety of said substantially conical surface;

providing a second grinding wheel on said pivoting grinding headstock, said second grinding wheel having a smaller diameter than a diameter of said first grinding wheel;

positioning said first grinding wheel with said axis of said first grinding wheel aligned parallel to said substantially conical surface and said outer grinding wheel surface aligned along a direction of said workpiece axis with said substantially conical surface of said workpiece in said chucked state such that a projection of said outer grinding wheel surface in a direction of said workpiece axis completely covers said substantially conical surface;

grinding said substantially conical surface with said outer grinding wheel surface such that said grinding is done with said workpiece in said chucked state by relatively displacing said workpiece and said first grinding wheel along said direction of said workpiece;

positioning said second grinding wheel into said longitudinal bore of said workpiece by pivoting on said pivoting grinding headstock; and grinding said interior wall with said workpiece in said chucked state by displacing said second grinding wheel and an interior wall of said longitudinal bore relative to one another;

wherein said workpiece remains in said chucked state from a time prior to said grinding of said interior wall and said substantially conical surfaces until said grinding of said interior wall and said substantially conical surface is completed.

2. The method of claim 1, wherein:

said positioning of said first grinding wheel is effected by pivoting said headstock, and moving said headstock in a direction perpendicular to said workpiece axis;

said grinding of said substantially conical surface is effected by moving said workpiece in said chucked state in a direction of said workpiece axis into said first grinding wheel; and said positioning of said second grinding wheel is effected by pivoting said headstock, and moving said headstock in a direction perpendicular to said workpiece axis.

3. The method of claim 2, wherein said first and second grinding wheels are respectively mounted on first and second spindles on said pivoting headstock which are spaced apart from one another and disposed on opposing sides of a pivot axis of said pivoting headstock.

4. The method of claim 2, wherein said interior wall of said longitudinal bore is ground using longitudinal grinding.

5. The method of claim 2, wherein said interior wall of said longitudinal bore is ground using peel grinding.

6. The method of claim 2, wherein said interior wall of said longitudinal bore is ground using infeed grinding.

7. The method of claim 1, wherein said substantially straight contour of said meridian cross-section is a straight contour, said substantially conical surface is a truncated cone surface, and said substantially straight line contour of said first grinding wheel is a straight line.

8. An apparatus for grinding a rotationally symmetrical workpiece having a first end side to be ground and an axially opposing second end side, and a central bore extending inward from said first side and coaxial with said workpiece axis, said apparatus comprising:

a chucking device for clamping of said workpiece at an exterior circumference of said second end side without chucking said workpiece at said first end side and rotating said workpiece about a workpiece axis;

a grinding spindle slide movable in spindle slide direction running transverse to the workpiece axis;

a device for longitudinal displacement of said workpiece in a direction of said workpiece axis;

a grinding headstock that is attached to said grinding spindle slide via a pivot having a pivot axis oriented orthogonal to said workpiece axis and said spindle slide direction;

first and second grinding spindles mounted on said grinding headstock and having axes orthogonal to said pivot axis;

a first grinding wheel mounted to said first grinding spindle, said first grinding wheel having first and second annular side surfaces, and an outer grinding wheel surface between said first and second annular side surfaces;

said outer grinding wheel surface being defined by a substantially straight line contour extending in an axial direction and parallel to an axis of said first grinding wheel and having a width in said axial direction of said first grinding wheel that is larger than a surface width of a substantially conical surface of said first side surface to be ground; and a second grinding wheel mounted on said second grinding spindle and having a smaller diameter than a diameter of said first grinding wheel;

said grinding headstock being pivotable on said pivot so as to:

position said first grinding wheel axis parallel to said substantially conical surface of said first side surface to be ground;

position said outer grinding wheel surface aligned along a direction of said workpiece axis with said substantially conical surface of said workpiece in said chucked state such that a projection of said outer grinding wheel surface in a direction of said workpiece axis completely covers said substantially conical surface; and position said second grinding wheel in said central bore with an axis of said second grinding wheel spaced from and parallel to said workpiece axis.

9. The apparatus of claim 8, wherein said first and second spindles are mounted on said pivoting headstock are spaced apart from one another and disposed on opposing sides of said pivot axis of said pivoting headstock.

10. The apparatus in accordance with claim 9, wherein in said first and second spindles run parallel to one another and said first and second grinding wheels are disposed on a common side of said pivoting headstock.

11. The apparatus of claim 10, wherein said chucking device is slidably mounted to slide in a direction of said workpiece axis.

12. The apparatus of claim 11, wherein said substantially straight line contour of said first grinding wheel is a straight line.

13. The apparatus of claim 8, further comprising a third grinding wheel mounted on a third spindle supported by said pivoting headstock, and said first, second and third spindles are mounted on said pivoting headstock at angle intervals of 120 degrees each.

14. The apparatus of claim 8, wherein said chucking device is slidably mounted to slide in a direction of said workpiece axis.

15. The apparatus of claim 14, wherein said substantially straight line contour of said first grinding wheel is a straight line.

16. The apparatus of claim 8, wherein said substantially straight line contour of said first grinding wheel is a straight line.

* * * * *